United States Patent [19]

Yang

[11] Patent Number: 4,676,262

[45] Date of Patent: Jun. 30, 1987

[54] LINK MEANS OF MULTIPLE-FOLD UMBRELLA

[76] Inventor: Chi-Kuo Yang, P.O. Box 10160, Taipei, Taiwan

[21] Appl. No.: 882,423

[22] Filed: Jul. 7, 1986

[51] Int. Cl.[4] ..... A45B 19/00

[52] U.S. Cl. ..... 135/25 R

[58] Field of Search ..... 135/25, 20, 26

[56] References Cited

U.S. PATENT DOCUMENTS

| | | | |
|---|---|---|---|
| 3,831,614 | 8/1974 | Weber | 135/25 R |
| 3,848,740 | 11/1974 | Weber | 135/25 R |
| 3,853,135 | 12/1974 | Schafer | 135/25 R |
| 3,856,031 | 12/1974 | Weber | 135/25 R |
| 4,420,007 | 12/1983 | Wu | 135/25 R |

FOREIGN PATENT DOCUMENTS

| | | | |
|---|---|---|---|
| 561846 | 10/1932 | Fed. Rep. of Germany | 135/25 R |
| 2353352 | 5/1974 | Fed. Rep. of Germany | 135/25 R |
| 2422209 | 11/1975 | Fed. Rep. of Germany | 135/25 R |
| 434020 | 1/1912 | France | 135/25 R |
| 1094607 | 5/1984 | U.S.S.R. | 135/25 R |

*Primary Examiner*—J. Karl Bell

[57] ABSTRACT

An umbrella for automatically extending an umbrella hood includes a plurality of link sets each formed with a thinning coupler pivotedly connected between several inner links respectively held on the brackets jacketed on a central handle, and several outer links extendibly supporting an umbrella hood, wherein the thinning coupler acts in commensuration with the other links to form a generally linear and stable configuration when extending an umbrella hood, and also to form a compact umbrella with minimized volume as folded.

1 Claim, 9 Drawing Figures

LINK MEANS OF MULTIPLE-FOLD UMBRELLA

BACKGROUND OF THE INVENTION

Britva disclosed, in his USSR Pat. No. 1094607, a folded umbrella having a plurality of link means shaped as double parallelograms as P1, P2 as shown in FIGS. 1 and 2. Each such double-parallelogram link means may shorten the length of a folded umbrella. However, the so many pivotting connections among the link means may be easily vibrated or twisted, when extending the umbrella hood supported by the link means, to thereby influence the stability of an umbrella in use. The double-parallelogram link means still occupies an appreciated space and can not be folded to get a minimum volume as viewed from FIG. 2, to thereby cause inconvenience for its handling or storage.

The present inventor has found the defects of the Russian patent as above-mentioned and invented the present multiple-fold umbrella having stabler link means in use and reduced volume as folded.

SUMMARY OF THE INVENTION

The object of the present invention is to provide an umbrella including a plurality of link means each having a thinning coupler pivotedly connecting each set of link means so that the link means of the umbrella can be stably extended to have a generally linear configuration by the closer connection among the thinning coupler and the other links internally connected under an umbrella hood, and the link means of the umbrella can also be greatly folded to form a compact collapsible umbrella by such closer connection of the thinning coupler with the other links.

DETAILED DESCRIPTION

Figure 1:
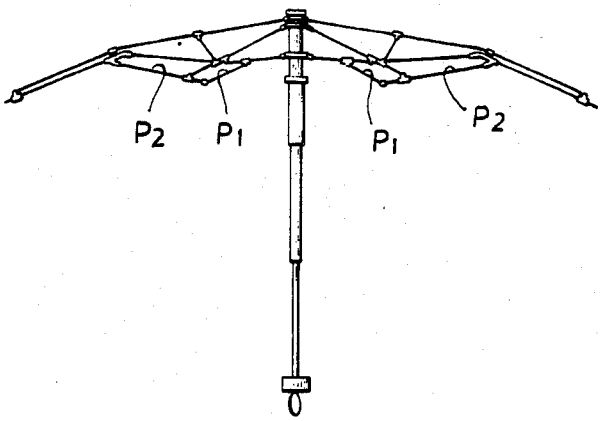
FIG. 1 PRIOR ART
FIG. 1 is an illustration showing an extended umbrella of a prior art.
Figure 2:
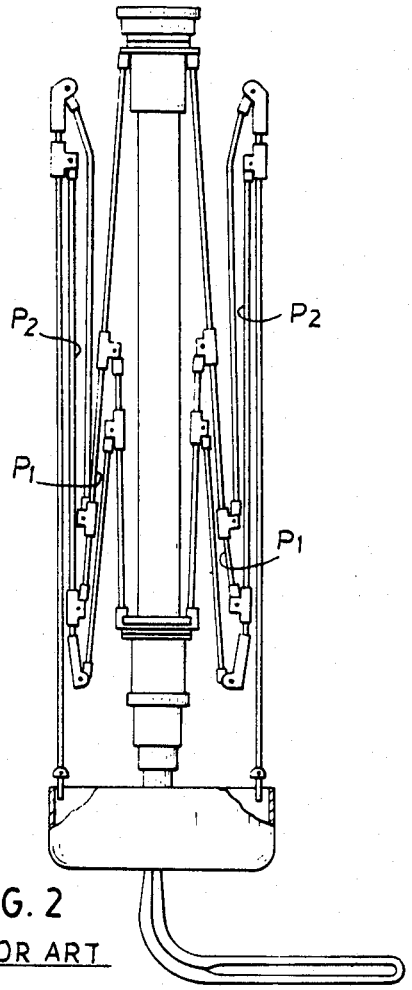
FIG. 2 PRIOR ART
FIG. 2 shows a collapsed umbrella folded from FIG. 1.

As shown in FIGS. 5–8, the present invention comprises: a first link 1 pivotedly secured to middle bracket 92 jacketed on a central handle 9, a second link 2 pivotedly secured to a lower bracket 93 jacketed on the central handle 9, a third link 3 juxtaposedly pivotedly formed under the first link 1, a thinning coupler 4 pivotedly connected to the third link 3, a fourth link 5 pivotedly connected to the coupler 4, a spring link 6 slidingly held within the fourth link 5, a fifth link 7 pivotedly secured to the fourth link 5 and a reinforcing wire 8 securing the first link 1 to an upper bracket 91 fixed on the top portion of the handle 9. An inner end 11 of first link 1 is pivotedly secured to the middle bracket 92 as restored by a spring 91*a* jacketed on the handle 9 and defined between the upper bracket 91 and the middle bracket 92. The middle portion 12 of first link 1 is pivotedly connected with the outermost 22 of the second link 2 by a pivot. The outer end 13 of first link 1 is pivotedly connected with an inner portion 63 next to an innermost end 62 of the spring link 6.

An inner end 21 of second link 2 is secured to the lower bracket 93. An outer portion 23 next to the outermost end 22 of the second link 2 is pivotedly connected with the inner end 31 of third link 3. The outermost end 22 of second link 2 is pivotedly connected with the middle portion 12 of first link 1. The outer end 32 of third link 3 is pivotedly connected with an innermost end 41 of the thinning coupler 4.

The inner portion 42 next to the innermost end 41 of coupler 4 is pivotedly connected with the innermost end 62 of spring link 6. The outer end 43 of coupler 4 is pivotedly connected with the inner end 52 of the fourth link 5.

Figure 5:
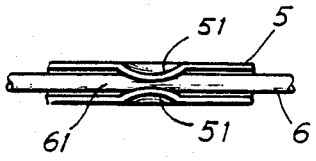
FIG. 5 is an illustration of the present invention as viewed from direction AA of FIG. 4.

The central portion 61 of spring link 6 is arcuatedly bent to be slidingly held within a collar portion 51 formed on the central portion of the fourth link 5. Such a collar 51 can be simply formed by inwards pressing the two upper edges of the link 5 to limit the link 6 therein as shown in FIG. 5.

An outer end 64 of spring link 6 is pivotedly connected with an innermost end 71 of the fifth link 7. The inner portion 72 next to the innermost end 71 is pivotedly connected with an outer end 53 of the fourth link 5. The outer end 73 is formed on the outermost end of the link means of the present invention.

Figure 7:
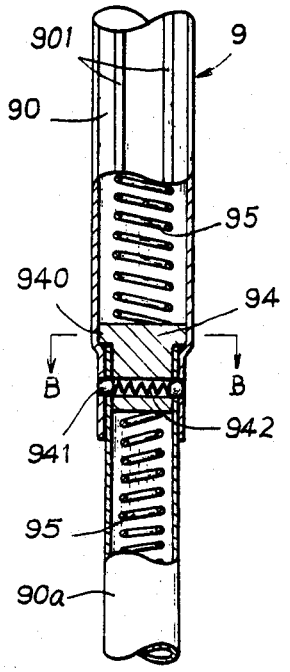
FIG. 7 is a sectional drawing of a central handle of the present invention.
Figure 8:
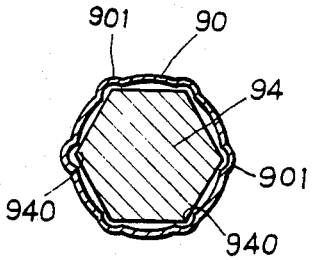
FIG. 8 is a cross sectional view from BB direction of FIG. 7.

The central handle 9 of the present invention includes an upper pipe 90 and a lower pipe 90*a* slidingly jacketed in the upper pipe 90. For fixing the two pipes 90, 90*a* as extended, a coupling plug 94 is formed in a junction of the two pipes, which includes a hexagonal head 940 slidingly engaged with six longitudinal grooves 901 hexagonally formed in the upper pipe 90 as shown in FIGS. 7 and 8, and a pair of balls 941 tensioned by a small spring 942 temporarily locking both pipes 90, 90*a* as shown in FIG. 7.

Figure 6:
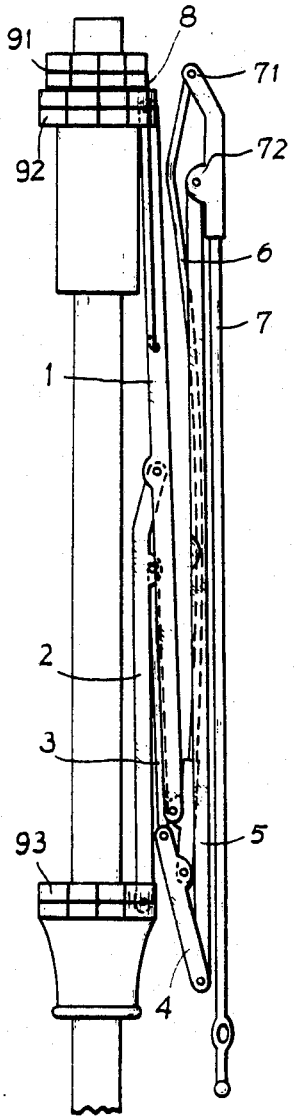
FIG. 6 shows a folded umbrella in accordance with the present invention.

The first link 1, second link 2, the coupler 4 and fourth link 5 are each formed with a longitudinal groove having a U-shape cross section. The transverse width of the groove of the second link 2 should be smaller than that of the first link 1, and the diameter of the third link 3 should be smaller than the transverse width of the groove of the second link 2, so that when folding the link means as shown in FIG. 6, the third link 3 can be embedded within the groove of the second link 2 and the second link 2 can be embedded into the groove of the first link 1 to minimize their space. The link 6 should also be adapted for the groove of the coupler 4.

Figure 4:
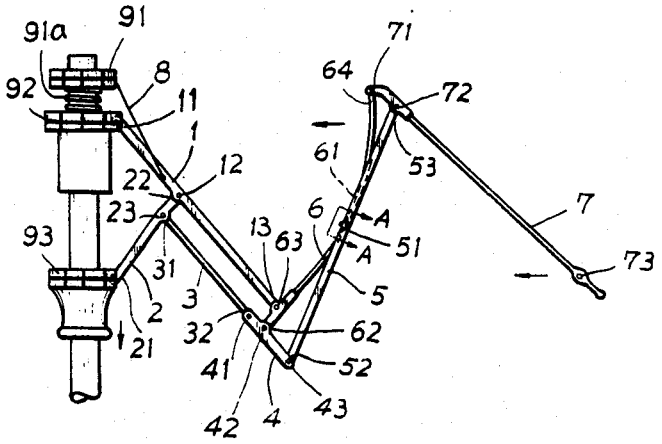
FIG. 4 shows an intermediate umbrella when folding from FIG. 3.

The distance between the innermost end 41 and the inner portion 42 pivotedly connecting the innermost end 62 of link 6, of couple 4 is equal to the height of the groove of first link 1 to minimize the "thickness" of the folded links as shown in FIG. 6. The distance between the outer portion 23, pivotedly connecting the inner end 31 of link 3, and the middle portion 12, pivotedly connecting the outermost end 22, is equal to the distance between the outer end 13 of first link 1 and the innermsot end of link 6, and is slightly larger than the distance between the innermost end 41 and the inner portion 42 of the coupler for snugly collapsible operation as shown in FIGS. 4 and 6.

Figure 3:
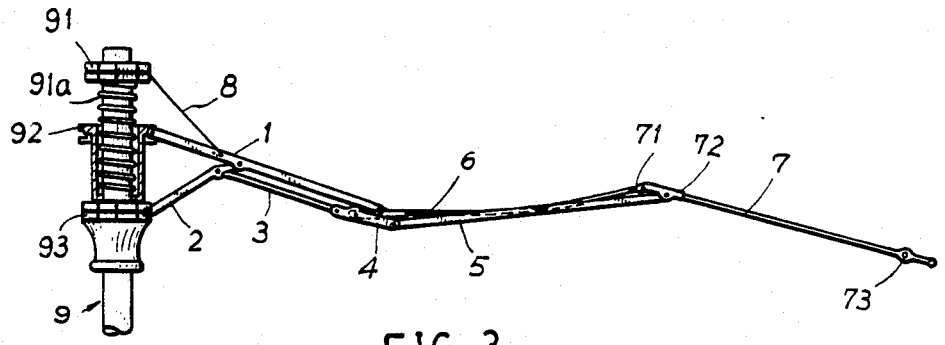
FIG. 3 shows an extended umbrella in accordance with the present invention.
Figure 6A:
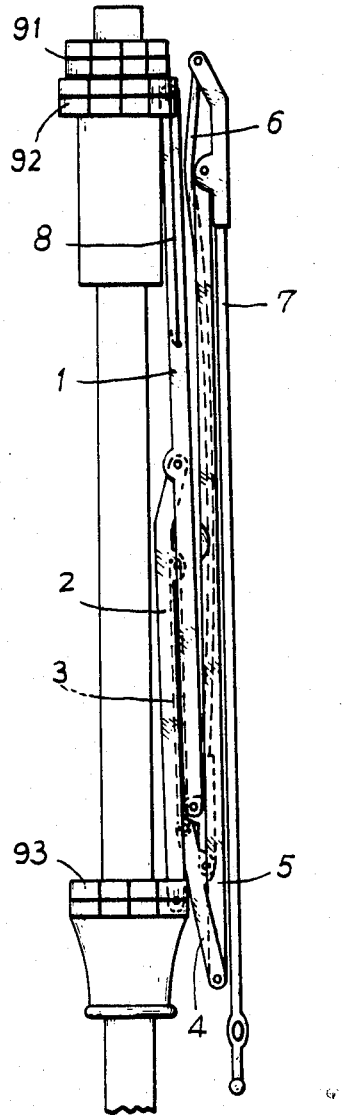
FIG. 6*a* is a still folded illustration following FIG. 6.

When using the umbrella of the present invention, the umbrella is extended as shown in FIG. 3 wherein the inner portion of link 6 is clamped in the groove of the coupler 4 and the spring link 6, resiliently retaining the outer link 7 and inner links 3, 1, 2, is mostly held within the groove of the fourth link 5, so that all the links are internally correlated to be a stable and generally linear configuration for possibly extending a larger umbrella hood. Meanwhile, the umbrella can be folded to minimize its volume as shown in FIGS. 6, 6*a* for compact and convenient handling or storage.

The above-mentioned link means is applicable for an umbrella for automatically extending an umbrella hood, for instance, a button (not shown) may be depressed to vertically extend the two pipes 90, 90*a* and to transversely extend the link means and umbrella hood of this invention automatically.

What is claimed is:

1. A link means of a mutliple-fold umbrella comprising:

a first link having its inner end secured to a middle bracket jacketed on a central handle and retained by a spring secured to an upper bracket fixed on the top portion of the central handle;

a second link having its inner end pivotedly secured to a lower bracket jacketed on the central handle and having its outermost end pivotedly connected with a middle portion of said first link;

a third link having its inner end pivotedly connected with an outer portion next to said outermost end of said second link, and its outer end pivotedly connected with an innermost end of a thinning coupler; the thinning coupler having an inner portion next to its innermost end pivotedly connected with an innermost end of a spring link and having an outer end pivotedly connected with an inner end of a fourth link;

the fourth link having a central portion formed as a collar portion for slidingly holding a central portion of a spring link;

the spring link having an inner portion next its innermost end pivotedly connected with an outer end of said first link and having a central portion arcuatedly bent to be slidingly held within said collar portion of said fourth link, and having its outer end pivotedly connected with an innermost end of a fifth link; the fifth link having an inner portion next to its innermost end pivotedly connected with an outer end of said fourth link; and a reinforcing wire securing said first link to the upper bracket; each said first link, said second link, the said thinning coupler and said fourth link being formed with a longitudinal groove having a U-shape cross section, the transverse width of the groove of said second link being smaller than that of said first link and being larger than the diameter of said third link;

the distance between said middle portion of said first link and said outer porion of said second link being equal to that between said outer end of said first link and said inner portion of said coupler, and being slightly larger that the distance between said innermost end and said inner portion of said coupler;

said inner portion of said spring link being adapted to be held in said groove of said coupler when extending the link means, whereby upon the extension of the link means, all said links and said coupler are extended to form a generally linear configuration and upon the folding of the link means, a compact umbrella with minimized volume can be folded, to be applicable for an automatic-extending umbrella.

* * * * *